US008875892B1

(12) United States Patent
Warner

(10) Patent No.: US 8,875,892 B1
(45) Date of Patent: Nov. 4, 2014

(54) MULTI-COMPARTMENT RING-SHAPED HOLDER

(71) Applicant: Dominique Warner, Pensacola, FL (US)

(72) Inventor: Dominique Warner, Pensacola, FL (US)

( * ) Notice: Subject to any disclaimer, the term of this patent is extended or adjusted under 35 U.S.C. 154(b) by 0 days.

(21) Appl. No.: 13/793,341

(22) Filed: Mar. 11, 2013

(51) Int. Cl.
*B65D 83/04* (2006.01)
*B65D 85/00* (2006.01)

(52) U.S. Cl.
CPC ..... *B65D 85/00* (2013.01)
USPC ..... 206/533; 206/539

(58) Field of Classification Search
USPC ..... 206/533, 534, 538–540, 818; 221/2, 69, 221/87, 89, 91, 154, 264, 265, 277
See application file for complete search history.

(56) References Cited

U.S. PATENT DOCUMENTS

| | | | | | |
|---|---|---|---|---|---|
| 1,586,606 | A | | 6/1926 | Cain | |
| 1,814,467 | A | | 7/1931 | Cedar | |
| 1,896,827 | A | | 2/1933 | Neely | |
| 2,236,224 | A | | 3/1941 | Raschkind | |
| 2,408,150 | A | | 9/1946 | Moeller | |
| 2,774,466 | A | * | 12/1956 | Liska | 206/538 |
| 2,943,730 | A | | 7/1960 | Tregilgas | |
| D189,888 | S | | 3/1961 | Tapper | |
| 2,975,887 | A | | 3/1961 | Weingart | |
| 3,143,207 | A | | 8/1964 | Wagner | |
| 3,227,127 | A | | 1/1966 | Gayle | |
| 3,414,161 | A | * | 12/1968 | Doring | 221/2 |
| 3,450,252 | A | | 6/1969 | Hallerbach | |
| 3,557,747 | A | | 1/1971 | Rigney et al. | |
| 3,559,854 | A | | 2/1971 | Loveland | |
| 3,638,830 | A | * | 2/1972 | Belokin, Jr. | 206/533 |
| 3,743,085 | A | | 7/1973 | Richert | |
| 4,069,942 | A | | 1/1978 | Marshall et al. | |
| 4,078,661 | A | | 3/1978 | Thomas | |
| 4,124,143 | A | | 11/1978 | Thomas | |
| 4,128,188 | A | | 12/1978 | White | |
| 4,203,518 | A | * | 5/1980 | Current | 206/533 |
| 4,778,054 | A | | 10/1988 | Newell et al. | |
| 4,989,420 | A | * | 2/1991 | Reinhold et al. | 221/76 |
| 5,154,296 | A | | 10/1992 | Cutler | |
| D358,986 | S | | 6/1995 | Heyl et al. | |
| 5,575,392 | A | | 11/1996 | Cutler | |
| 6,325,241 | B1 | * | 12/2001 | Garde et al. | 221/87 |
| D475,618 | S | | 6/2003 | Barnes et al. | |
| 7,159,720 | B2 | * | 1/2007 | Pearson | 206/533 |
| D626,432 | S | | 11/2010 | Luciano et al. | |
| D626,433 | S | | 11/2010 | Luciano et al. | |
| 8,033,422 | B2 | * | 10/2011 | Estrada | 221/89 |

* cited by examiner

*Primary Examiner* — Luan K Bui
(74) *Attorney, Agent, or Firm* — Peter Loffler

(57) ABSTRACT

A multi-compartment holder has an inner ring with multiple compartments, each accessible through its respective first opening. The inner ring is rotatably seated within an outer ring that has a second opening so that as the inner ring is rotated with respect to the outer ring, each compartment's first opening, aligns, in turn, with the outer ring opening, allowing access into the particular compartment through the aligned first opening of the compartment and second opening of the outer ring.

6 Claims, 5 Drawing Sheets

MULTI-COMPARTMENT RING-SHAPED HOLDER

BACKGROUND OF THE INVENTION

1. Field of the Invention

The present invention relates to a multi-compartment, user loaded holder for holding an individual set of medications for the user, the holder being ring shaped.

2. Background of the Prior Art

Many people take medications for all sorts of ailments as well as vitamins and supplements in an effort to help prevent such ailments. Many medicine and vitamin consumers keep the products in their original container, which is satisfactory for home usage and storage. However, when traveling, even for the day such as going to work or for a pleasure trip, keeping medicines, vitamins, and supplements in their original containers can prove awkward.

As many of the containers are relatively large and bulky keeping a product in its original container makes transporting the container difficult, especially when multiple containers are needed. Not many people want to travel around with a shopping bag full of various containers, especially when traveling by commercial carrier such as by airplane. Additionally, whenever it is time to take the products, possibly three or four times a day, each container must be individually opened, the appropriate amount of the product removed, and thereafter the container closed. While workable, this time-consuming and tedious procedure is not welcome by most.

A simple solution to this problem is to place all of the medicines, vitamins and/or supplements into a single container so that only a single container must be carried, stored, and manipulated by the user. Unfortunately, this solution is fraught with problems in that various medicines have varying dosing requirements (some may be taken as a single dose 3 times a day, some might be taken a double dose, twice a day, etc.), and as most people are not sufficiently intimate with their pills as to know not only what the dosage requirements are for each medicine, but also what each medicine looks like, so that the correct medicine in the correct amount can be retrieved from the container. This solution tends to work only for the most disciplined users.

To address the above, multi-pill storage containers have been proposed. These containers, which come in various architectures, have multiple compartments that allow a user to place a single sitting dosage into each compartment. For example, one compartment may be for morning pills and the other for evening pills. In this way, the pills are stored in a relatively compact container and are segregated into the proper dosages for each time period of pill consumption. Whenever it is time for a person's medicine, including vitamins and supplements, the compartment containing the pills for the particular time period is opened, the contents retrieved therefrom, and consumed in the usual way. While many of these devices are effective, they still suffer from certain shortcomings.

Some of these devices have relatively simple pop open and snap shut lids. If a user places such a container into her purse and is not careful, one or more of the lids can inadvertently open allowing the contents of those cells of the container to spill either into the purse, or possibly onto the ground if the lids open when the device is being retrieved. Additionally, many people are self-conscious about their medicine containers and do not necessarily want others to know that the user is carrying medicine, especially in situations when the user is hand carrying their medicine to assure that it is not lost. As many of the pill storage containers are immediately identifiable as pill containers, many users find a certain level of discomfort in using such devices for pill transport.

What is needed is a device that allows pills, including medicine, vitamins, and supplements, to be stored for transport, which device addresses the above mentioned shortcomings found in the art. Such a device must allow the pills to be segregated so that the correct pills in the correct amounts are immediately available at a particular pill consuming time. Such a device must minimize the risk of content spillage from the device. Such a device must not have a sterile utilitarian look to it so that users may fell less self-conscious carrying their pills in the device whenever the device is exposed to view. Ideally, such a device must be relatively simple to use.

SUMMARY OF THE INVENTION

The multi-compartment ring shaped holder of the present invention addresses the aforementioned needs in the art by providing a device that has multiple compartments such that all pills in the correct dosage for a single pill consuming time can be stored into one of the compartments and retrieved therefrom at the correct time. The multi-compartment ring shaped holder is designed so as to minimize the risk of inadvertent spillage of the contents from the device. The multi-compartment ring shaped holder is generally opaque and can be decorated as desired, and by being ring shaped, lacks the utilitarian look of many prior art devices and can even be worn as a bracelet by a user. The multi-compartment ring shaped holder is of relatively simple design and construction, being produced using standard manufacturing techniques so as to be relatively inexpensive to produce. The multi-compartment ring shaped holder is relatively easy to use and can be used to carry various other items besides medicines, such as small items of jewelry, coins, etc.

The multi-compartment ring shaped holder is comprised of an inner ring having a first outer periphery. The inner ring has a series of compartments each compartment having its own first opening at the first outer periphery. An outer ring has a second outer periphery, a closed top, and an open bottom leading to a channel. A second opening is located on the second outer periphery. The inner ring is received within the channel of the outer ring and is capable of rotating within the channel of the outer ring and such that as each first opening aligns with the second opening the respective compartment associated with that particular first opening is accessible through the aligned first opening and second opening, otherwise the compartment is not accessible through the second opening. A closure wall is located on the first outer periphery such that when the closure wall is aligned with the second opening, no compartment is accessible through the second opening. A pair of concentric annular lips is located on either side of the channel at the open bottom of the outer ring. The outer ring is made from a resilient plastic material.

BRIEF DESCRIPTION OF THE DRAWINGS

Similar reference numerals refer to similar parts throughout the several views of the drawings.

DESCRIPTION OF THE PREFERRED EMBODIMENT

Figure 1:
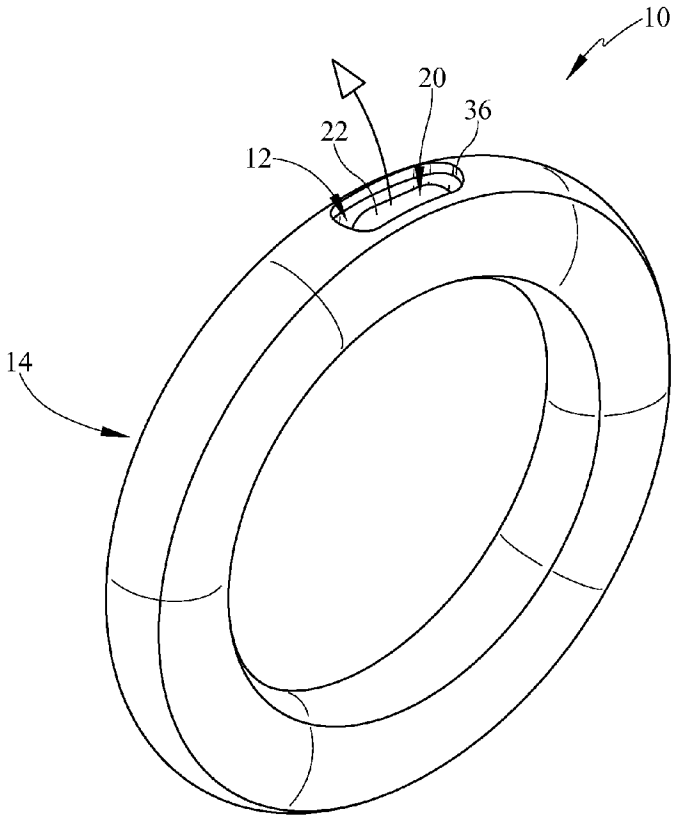
FIG. 1 is a perspective view of the multi-compartment ring shaped holder of the present invention.
Figure 2:
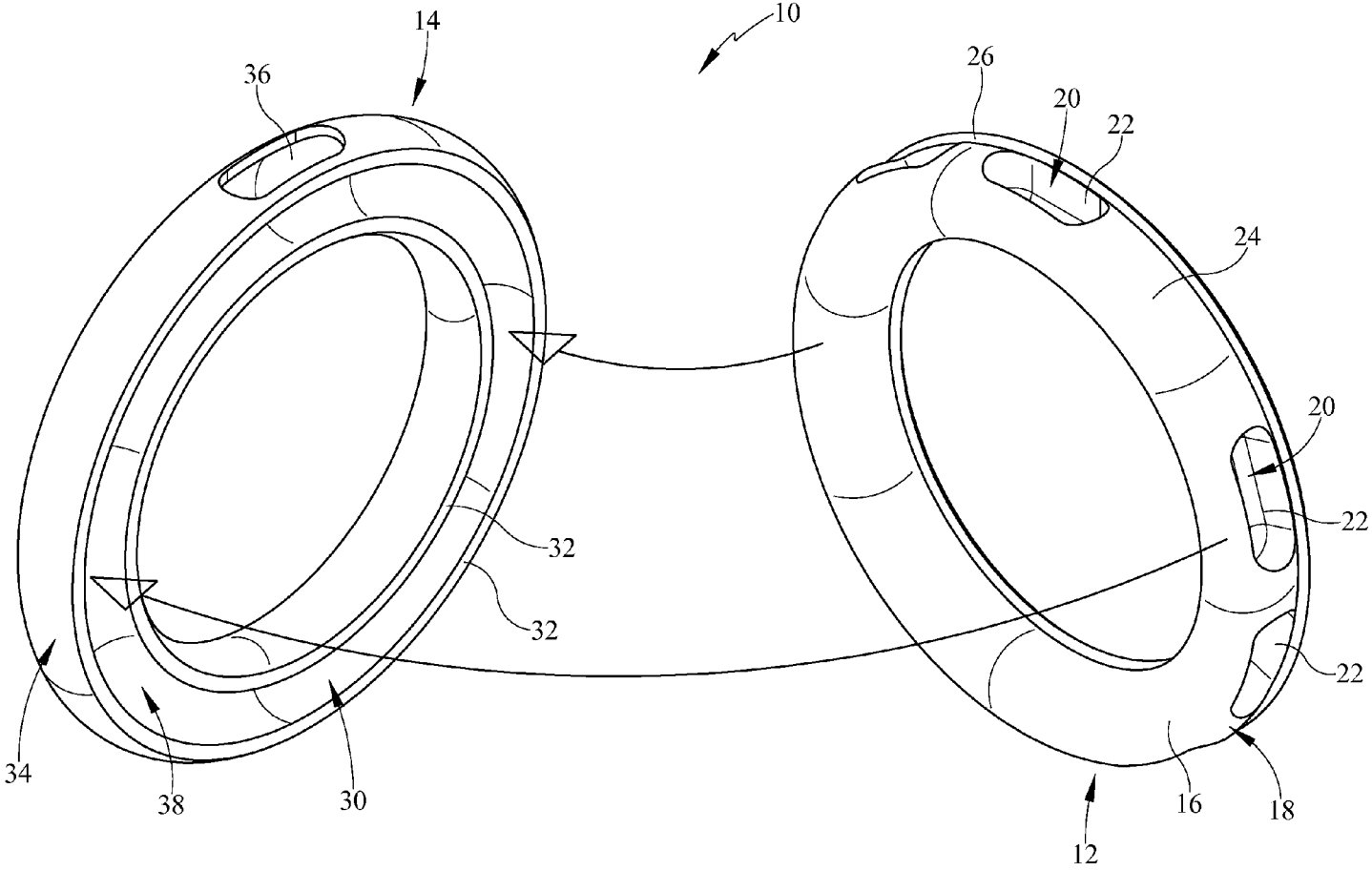
FIG. 2 is an exploded perspective view of the multi-compartment ring shaped holder.
Figure 5:
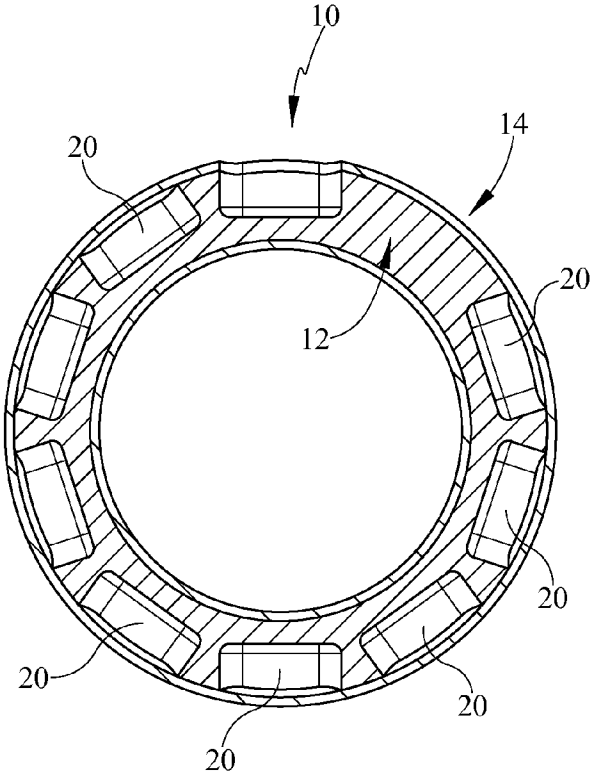
FIG. 5 is a sectioned view of the multi-compartment ring shaped holder taken along line 5-5 in FIG. 3.
Figure 4:
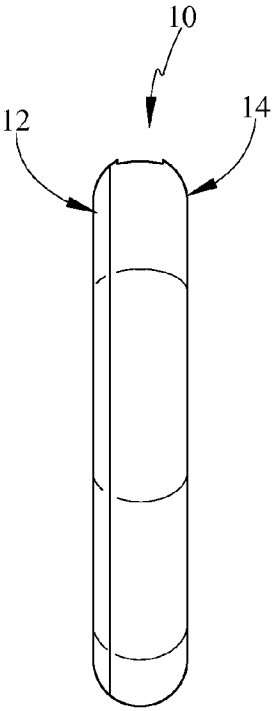
FIG. 4 is a side elevation view of the multi-compartment ring shaped holder.
Figure 3:
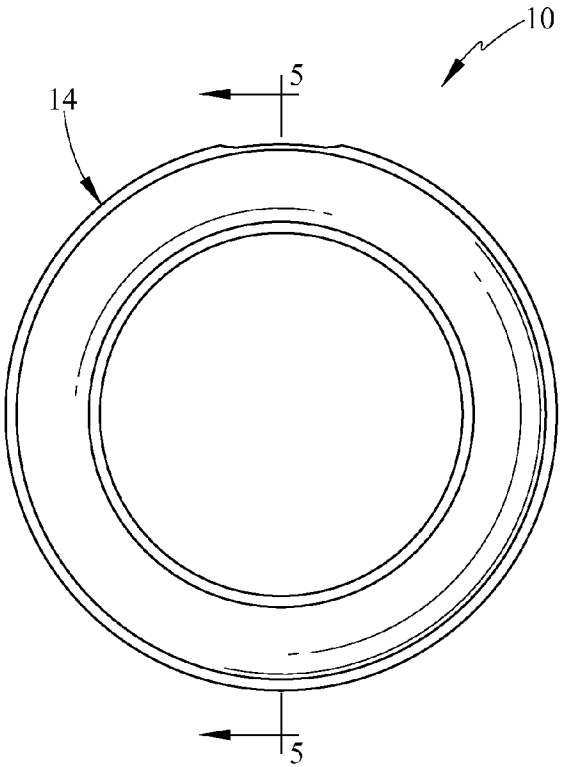
FIG. 3 is a rear elevation view of the multi-compartment ring shaped holder.
Figure 6:
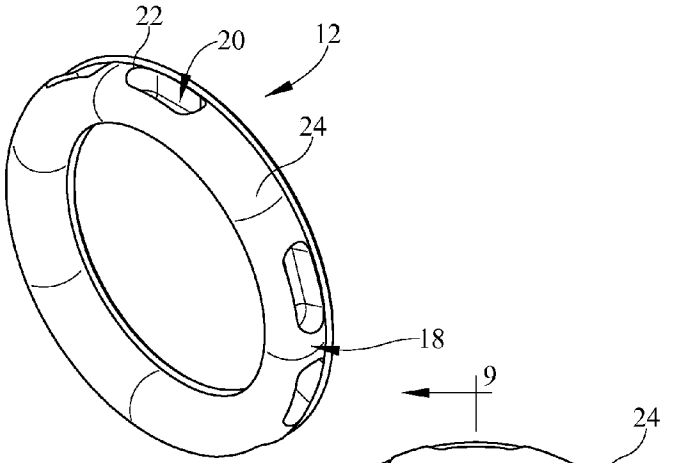
FIG. 6 is a perspective view of the inner ring of the multi-compartment ring shaped holder.
Figure 7:
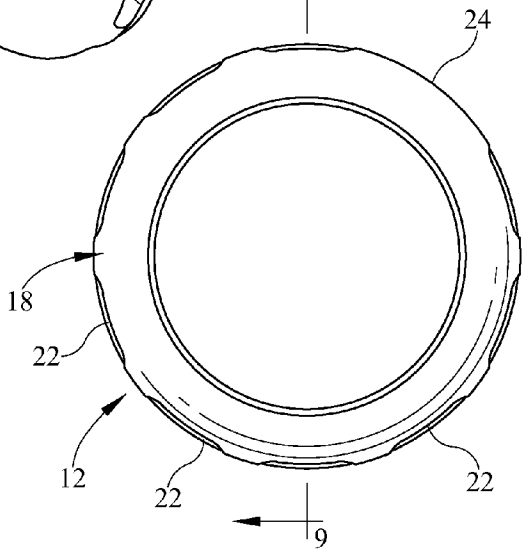
FIG. 7 is a front elevation view of the inner ring of the multi-compartment ring shaped holder.
Figure 8:
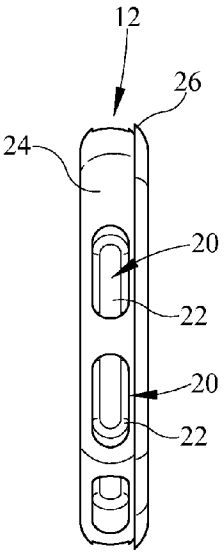
FIG. 8 is a side elevation view of the inner ring of the multi-compartment ring shaped holder.
Figure 9:
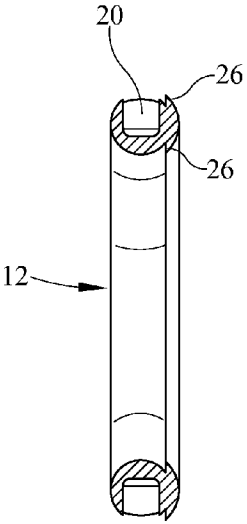
FIG. 9 is a side sectioned view of the inner ring of the multi-compartment ring shaped holder taken along line 9-9 in FIG. 7.
Figure 12:
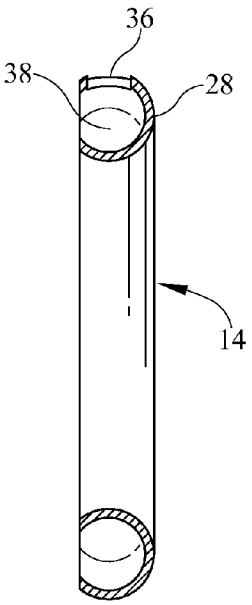
FIG. 12 is a side sectioned view of the outer ring of the multi-compartment ring shaped holder taken along line 12-12 in FIG. 11.
Figure 11:
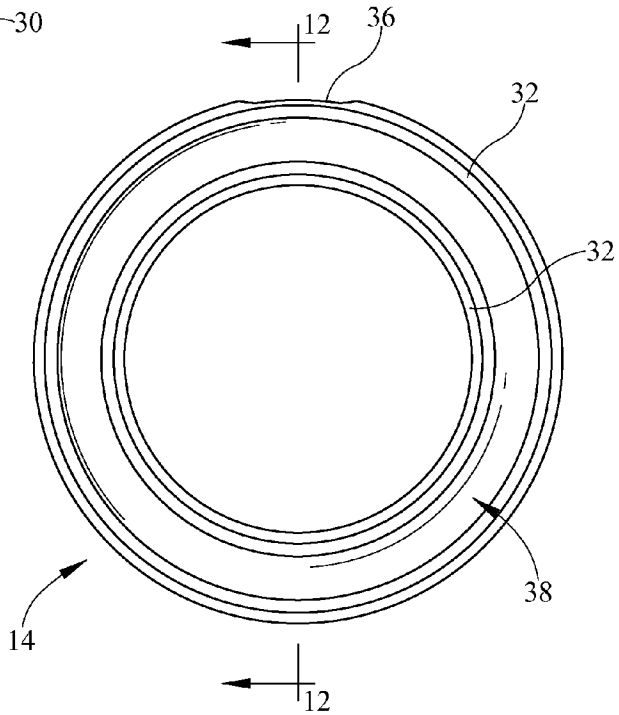
FIG. 11 is a rear elevation view of the outer ring of the multi-compartment ring shaped holder.
Figure 10:
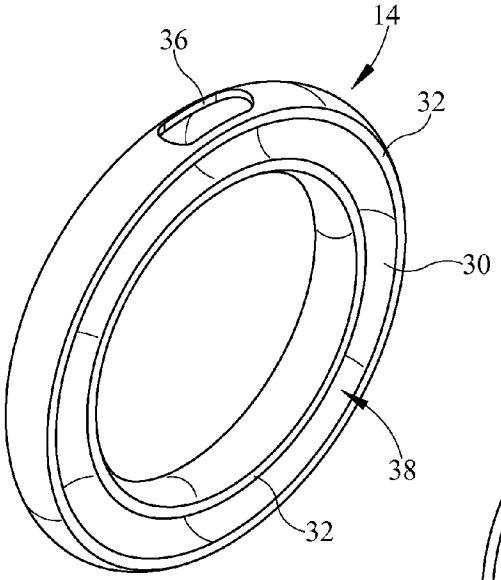
FIG. 10 is a rear perspective view of the outer ring of the multi-compartment ring shaped holder.

Referring now to the drawings, it is seen that the multi-compartment ring shaped holder of the present invention, generally denoted by reference numeral 10, is comprised of a an inner ring 12 and an outer ring 14.

The inner ring 12 is essentially a tubular ring shaped member that has a top 16 and an outer periphery 18 and that has a series of compartments 20 that each have an opening 22 located on the outer periphery 18. The compartments 20 are spaced substantially about the entire inner ring 12 expect for a single area where there is no compartment 20 and thus no opening, this area defining a closure wall 24. A pair of annular lips 26 is located on the bottom of the inner ring 12. The inner ring 12 is made from a hard sturdy material such as plastic.

As seen, the outer ring 14 is a ring shaped member that has a closed top 28, an open bottom 30 that has a pair of concentric annular lips 32 extending therearound, and an outer periphery 34 that has a single opening 36 thereon. A channel 38 is defined within the outer ring 14 accessible through the open bottom 28. The outer ring 14 is made from a hard sturdy material such as plastic and has a certain amount of resiliency.

The inner ring 12 is nested within the outer ring 14 by pushing the top 16 of the inner ring 12 through the open bottom 30 of the outer ring 14. As the inner ring 12 is larger relative to the opening between the lips 32 at the open bottom 30 of the outer ring 14, the resiliency of the outer ring 14 allows the lips 32 to spread and allows the inner ring 12 to push therepast and into the channel 38 wherein the inner ring 12 seats and is able to freely rotate within the channel 38. The shape of the inner ring 12 corresponds to the shape of the channel 38 of the outer ring 14 allowing this free rotation of the inner ring 12. The annular lips 26 of the inner ring 12 seat on the annular lips 32 of the outer ring 14 helping the two rings 12 and 14 stay aligned with one another during inner ring 12 rotation. Once the inner ring 12 is properly within the channel 38 of the outer ring 14, the resiliency of the outer ring 14 brings the annular lips 32 back toward each other to their normal relaxed state so as to hold the inner ring 12 within the channel 38.

As the inner ring 12 is rotated a 360 degree revolution with respect to the outer ring 14, the openings 22 of each compartment 20, align, in turn with the single opening 36 of the outer ring 14 allowing access into the particular compartment 20. Therefore, the multi-compartment ring shaped holder 10 is loaded, by rotating the inner ring 12 with respect to the outer ring 14, and as each compartment 20 is accessible through the aligned single opening 36 of the outer ring and the particular compartment's opening 22, the compartment 20 is loaded as desired. Thereafter, the inner ring 12 is rotated so as to align the next compartment opening 22 with the single opening 36 of the outer ring 14, which gives access to this next compartment 20 and also closes the previously loaded compartment 20. When the closure wall 24 of the inner ring 12 is aligned with the single opening 36 of the outer ring 14, the multi-compartment ring shaped holder 10 is closed as no compartment 20 is accessible. Similarly, when access to a compartment 20 is desired, for example, to retrieve items therein, that compartment's opening 22 is aligned with the single opening 36 of the outer ring 14 and the contents are retrieved from the compartment 20.

If desired, a click stop system not illustrated) can be installed onto the multi-compartment ring shaped holder 10 so that as each compartment opening 22 is properly aligned with the single opening 36 of the outer ring 14, the inner ring 12 click stops and is lightly held in position by the click stop system. Additionally, an appropriate latch or other holding system can be installed onto the multi-compartment ring shaped holder 10 so that when the closure wall 24 is aligned with the single opening 36 of the outer ring 14, and the multi-compartment ring shaped holder 10 is closed, the latch or other hold system maintains the multi-compartment ring shaped holder 10 in the closed position and prevents inadvertent opening of one or more of the compartments 20.

The outer ring 14 and the exposed portion of the inner ring 12 can be decorated as desired and the multi-compartment ring shaped holder 10 used as a bracelet so as to disguise its utilitarian function.

While the invention has been particularly shown and described with reference to an embodiment thereof, it will be appreciated by those skilled in the art that various changes in form and detail may be made without departing from the spirit and scope of the invention.

I claim:

1. A holder comprising:

an inner ring having a first outer periphery, a first inner periphery, a closed first top, and a closed first bottom the inner ring having a series of compartments each compartment having a first opening at the first outer periphery;

an outer ring that having a central opening and having a second outer periphery, a second inner periphery, a closed second top, and an open second bottom leading to a channel, the channel defined by a first inner surface of the second outer periphery, a second inner surface of the second top, and a third inner surface of the second inner periphery, the outer ring also having a second opening located on the second outer periphery; and such that the inner ring is nested within the channel of the outer ring such that the first outer periphery faces the first inner surface of the second outer periphery, the first top faces the second inner surface of the second top, and the first inner periphery faces the third inner surface of the second inner periphery, the inner ring capable of rotating within the channel and such that as each first opening aligns with the second opening the respective compartment associated with the particular first opening is accessible through the aligned first opening and second opening, otherwise the compartment is not accessible.

2. The holder as in claim 1 wherein a closure wall is located on the first outer periphery such that there is no compartment behind the closure wall and such that when the closure wall is aligned with the second opening, no compartment is accessible through the second opening.

3. The holder as in claim 2 further comprising:

a pair of concentric first annular lips located on either side of the channel at the open first bottom of the outer ring; and a pair of concentric second annular lips located on a second bottom of the inner ring such that each second annular lip seats on a respective one of the first annular lips.

4. The holder as in claim 3 wherein the outer ring is made from a resilient plastic material.

5. The holder as in claim 1 further comprising:

a pair of concentric first annular lips located on either side of the channel at the open first bottom of the outer ring; and a pair of concentric second annular lips located on a second bottom of the inner ring such that each second annular lip seats on a respective one of the first annular lips.

6. The holder as in claim 1 wherein the outer ring is made from a resilient plastic material.

* * * * *